US006743056B2

(12) United States Patent
Kunugi

(10) Patent No.: US 6,743,056 B2
(45) Date of Patent: Jun. 1, 2004

(54) SOCKET APPARATUS FOR SUPPLYING POWER SOURCE

(75) Inventor: Masanori Kunugi, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/374,063

(22) Filed: Feb. 27, 2003

(65) Prior Publication Data

US 2003/0171038 A1 Sep. 11, 2003

(30) Foreign Application Priority Data

Mar. 5, 2002 (JP) ..... P2002-058712

(51) Int. Cl.[7] ..... H01R 24/04
(52) U.S. Cl. ..... 439/668
(58) Field of Search ..... 439/10, 181, 668, 439/669, 886, 887

(56) References Cited

U.S. PATENT DOCUMENTS 2,700,137 A * 1/1955 Ragan ..... 333/261
4,743,201 A * 5/1988 Robinson et al. ..... 439/10
6,290,545 B1 * 9/2001 Wang et al. ..... 439/668

* cited by examiner

*Primary Examiner*—Renee Luebke
*Assistant Examiner*—Ann McCamey
(74) *Attorney, Agent, or Firm*—Sughrue Mion, PLLC

(57) ABSTRACT

A socket apparatus for supplying a power source includes a cylindrical adapter having a front face and an outer peripheral face and a socket body having a cylindrical insertion hole into which the adapter is inserted. The adapter has a guide portion, provided on the outer peripheral face, a first contact portion, provided on the front face, and a second contact, provided on the outer peripheral face. The socket body has a first guide groove for guiding the guide portion, provided on an inner peripheral face of the insertion hole, a third contact portion, provided on a bottom face of the insertion hole, and electrically connected to the first contact portion when the adapter is inserted into the insertion hole, a fourth contact portion, provided on the inner peripheral face, and electrically connected to the second contact portion, a second guide groove, provided on the inner peripheral face so that the adapter pivots while the guide portion engages the second guide groove, and a fifth contact portion, provided on at least one of the inner peripheral face and the outer peripheral face so as to continuously contact at least one of the second contact portion and the fourth contact portion, and the fifth contact portion is lower than the at least the second contact portion and the fourth contact portion in electrical conductivity. The fifth contact portion is disposed on an upstream side in a rotation path of the second contact portion during the adapter pivots.

4 Claims, 6 Drawing Sheets

SOCKET APPARATUS FOR SUPPLYING POWER SOURCE

BACKGROUND OF THE INVENTION

The present invention relates to a socket apparatus which supplies power source for a vehicle to an adapter such as a cigar lighter etc.

Such a kind of related power source socket apparatus is shown in FIGS. 6 and 7. As shown in FIGS. 6 and 7, a power source socket apparatus 1 is configured by a socket main body 2 for a cigar lighter and an adapter 3. The cigar lighter socket main body 2 is provided with an insertion hole 4. Power source side contact points 5*a*, 5*b* are provided at the bottom wall 4*a* and the inner peripheral wall 4*b* of the insertion hole 4, respectively. The pair of the power source side contact points 5*a*, 5*b* are supplied with a power source voltage from the vehicle power source through a power source line.

The adapter 3 is provided at the insertion hole 4 so as to be freely inserted therein and drawn therefrom. Load side contact points 6*a*, 6*b* are provided at the tip end surface 3*a* and the outer peripheral surface 3*b* of the adapter, respectively.

When the adapter 3 is inserted into the insertion hole 4 of the cigar lighter socket main body 2, the load side contact point 6*a* on the tip end surface 3*a* of the adapter 3 is made in contact with the power source side contact point 5*a* on the bottom wall 4*a* of the insertion hole 4 and also the load side contact point 6*b* on the outer peripheral surface 3*b* of the adapter 3 is made in contact with the power source side contact point 5*b* on the inner peripheral wall 4*b* of the insertion hole 4, whereby the vehicle power source is supplied to the adapter 3.

The power source for a current vehicle outputs a low voltage of 14 volts. Thus, arc discharge scarcely occurs even if the power source side contact points 5*a*, 5*b* are respectively made in contact with or separated from the load side contact points 6*a*, 6*b* in a state where the low voltage is applied. Therefore, the related power source socket apparatus 1 is not provided with a mechanism for preventing the arc discharge.

However, in recent years, a high-voltage vehicle with an output power of 42 volts has been developed on which a motor generator advantageous in the fuel cost of a vehicle is mounted. According to such a high-voltage vehicle, the power source voltage is three times as large as the current power source voltage (14 volts) for a vehicle, so that the provability where the arc discharge occurs at the time of inserting and drawing the adapter is also three times as large as that of the current power source for a vehicle. Therefore, a mechanism for preventing the arc discharge is required. Further, the contact points are very likely damaged by the arc discharge and so a mechanism for preventing the arc discharge is required.

SUMMARY OF THE INVENTION

It is therefore an object of the present invention to provide a socket apparatus, which can prevent occurrence of the arc discharge at the time of inserting and drawing an adapter thereby to improve safety and prevention of disaster property for a user and also can prevent the damage of contact points.

In order to achieve the above object, according to the present invention, there is provided a socket apparatus for supplying a power source comprising:

a cylindrical adapter having a front face and an outer peripheral face, including;

a guide portion, provided on the outer peripheral face;

a first contact portion, provided on the front face; and a second contact, provided on the outer peripheral face, and a socket body having a cylindrical insertion hole into which the adapter is inserted, including;

a first guide groove for guiding the guide portion, provided on an inner peripheral face of the insertion hole, a third contact portion, provided on a bottom face of the insertion hole, and electrically connected to the first contact portion when the adapter is inserted into the insertion hole;

a fourth contact portion, provided on the inner peripheral face, and electrically connected to the second contact portion;

a second guide groove, provided on the inner peripheral face so that the adapter pivots while the guide portion engages the second guide groove; and a fifth contact portion, provided on at least one of the inner peripheral face and the outer peripheral face so as to continuously contact at least one of the second contact portion and the fourth contact portion, and the fifth contact portion is lower than the at least the second contact portion and the fourth contact portion in electrical conductivity, and wherein the fifth contact portion is disposed on an upstream side in a rotation path of the second contact portion during the adapter pivots.

Preferably, the fifth contact portion is provided on the inner peripheral face so as to continuously connect the fourth contact portion.

Preferably, the second contact portion is separated from the fourth contact portion in a state that the adapter is inserted into the insertion hole along the first guide groove.

Preferably, the second guide groove is communicated with the first guide groove at a lower portion of the first guide groove, and the second guide groove is extending in a circumferential direction of the insertion hole.

In the configurations, when the adapter is inserted into the insertion hole of the socket body and then the inserted adapter is rotated, each of the second contact portion provided on the outer peripheral face of the adapter is contacted with the corresponding fourth contact portion on the inner peripheral face of the socket body through the fifth contact portion and thereafter directly contacts with the corresponding fourth contact portion. In a state where the second contact portion is contacted with the corresponding fourth contact portion through the corresponding low electric conductivity fifth contact portion, a low current flows therebetween. Therefore, an occurrence of the arc discharge at the time of inserting and drawing an adapter is prevented, thereby safety and prevention of disaster property for a user are improved and the damage of contact points can be prevented. Also, a high current flows for the first time when the second contact portion is directly contacted with the corresponding fourth contact portion.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 3(A) and 3(B) are diagrams showing the embodiment of the invention, wherein FIG. 3A is a sectional diagram cut along a line A—A in FIG. 1 and showing that the adapter is inserted and both contact points are placed in a non-conductive state therebetween, and FIG. 3B is a sectional diagram cut along the line A—A in FIG. 1 and showing that the adapter thus inserted is rotated and both the contact points are placed in a conductive state therebetween;

FIGS. 4(A) and 4(B) are diagrams showing the embodiment of the invention, wherein FIG. 4A is a sectional diagram cut along a line B—B in FIG. 1 and showing that the adapter is inserted and both the contact points are placed in a non-conductive state therebetween, and FIG. 4B is a sectional diagram cut along the line B—B in FIG. 1 and showing that the adapter thus inserted is rotated and both the contact points are placed in a conductive state therebetween;

FIGS. 5(A) and 5(B) are diagrams showing an modified example of the embodiment of the invention, wherein FIG. 5A is a sectional diagram showing a state where the adapter is inserted and both the contact points are placed in a non-conductive state therebetween, and FIG. 5B is a sectional diagram showing a state where the adapter thus inserted is rotated and both the contact points are placed in a conductive state therebetween;

FIGS. 8A and 8B are diagrams showing an alternative embodiment of the invention, wherein FIG. 8A is a sectional diagram cut along a line B—B in FIG. 1 and showing that the adapter is inserted and both the contact points are placed in a non-conductive state therebetween, and FIG. 8B is a sectional diagram cut along the line B—B in FIG. 1 and showing that the adapter thus inserted is rotated and both the contact points are placed in a conductive state therebetween.

DETAILED DESCRIPTION OF THE PREFERRED EMBODIMENTS

Embodiments of the invention will be explained with reference to the accompanying drawings. A first embodiment of the present invention will be explained based on FIGS. 1 to 4B.

Figure 1:
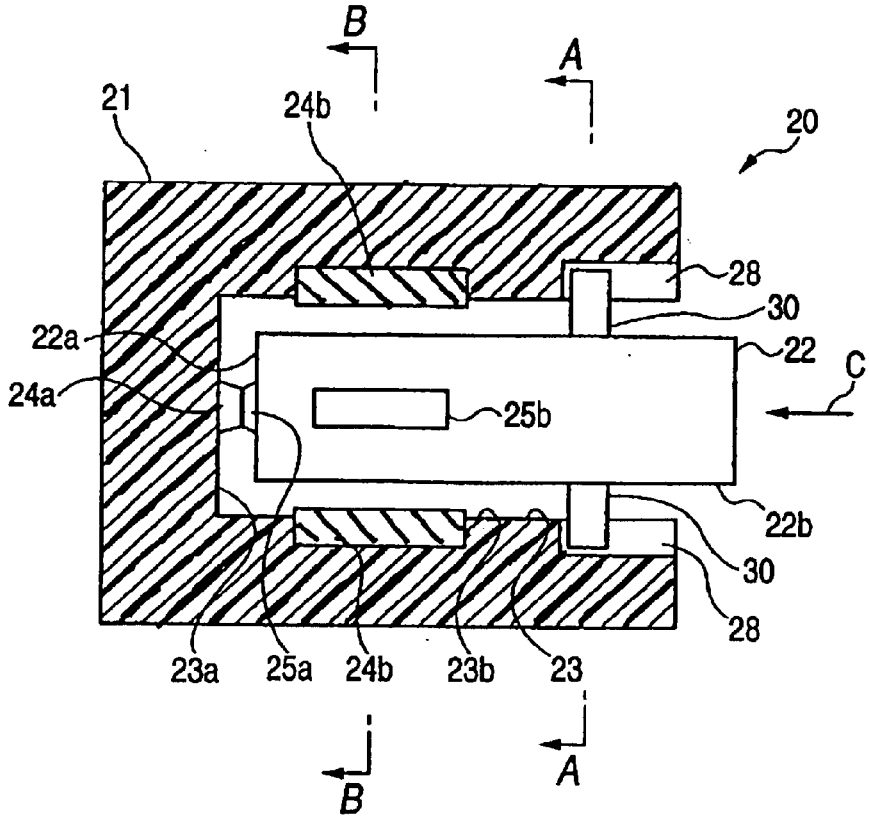
FIG. 1 is a sectional diagram showing a state where an adapter is attached to a socket main body for a cigar lighter of an embodiment according to the invention.

In FIG. 1, a socket apparatus 20 for supplying a power source includes a cigar lighter socket main body 21 and a adapter 22 which can be freely inserted into and drawn from the cigar lighter socket main body 21. The cigar lighter socket main body 21 is disposed in the vicinity of an ash tray such as the center console portion etc. of the instrument panel of a vehicle. The cigar lighter socket main body 21 has an insertion hole 23 opened within the vehicle. Power source side contact points 24*a*, 24*b* are provided at a bottom wall 23*a* and an inner peripheral wall 23*b* of the insertion hole 23, respectively. The power source side contact points 24*b* on the inner peripheral wall 23*b* are provided at two portions which are disposed in an opposite relation with an angular interval of 180 degrees therebetween. The power source side contact point 24*a* on the bottom wall 23*a* side is set to be a plus (+) contact point and the power source side contact point 24*b* on the inner peripheral wall 23*b* side is set to be a minus (−) contact point, whereby the power source voltage from the vehicle power source is supplied through a power source supply line. The power source side contact points 24*a*, 24*b* are formed by high electric conductivity member.

The adapter 22 has a cylindrical shape which diameter is slightly smaller than that of the insertion hole 23. The load side contact points 25*a*, 25*b* are provided at the tip end surface 22*a* and the outer peripheral surface 22*b* of the adapter, respectively. The load side contact points 25*b* of the outer peripheral surface 22*b* are provided at two portions which are disposed in an opposite relation with an angular interval of 180 degrees therebetween. The load side contact point 25*a* on the tip end surface 22*a* side is set to be a plus (+) contact point and the load side contact point 25*b* on the outer peripheral surface 22*b* side is set to be a minus (−) contact point. An exothermic member is disposed between both the load side contact points 25*a* and 25*b*. The load side contact points 25*a*, 25*b* are formed by high electric conductivity member.

Figure 2:
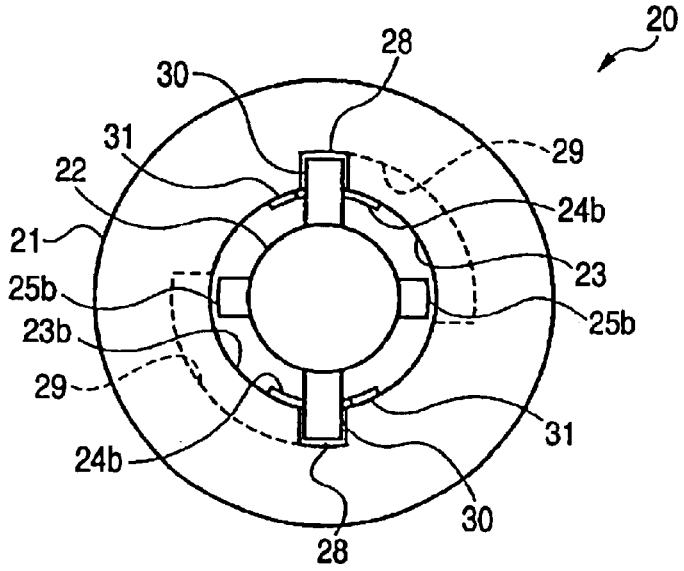
FIG. 2 is a diagram showing the adapter seen from a direction shown by an arrow C in FIG. 1.

As shown in FIGS. 2 and 3 in detail, the inner peripheral wall 23*b* of the insertion hole 23 is provided with a pair of insertion guide grooves 28 which are disposed in an opposite relation with an angular interval of 180 degrees therebetween and each of which extends in an axial direction of the cigar lighter socket main body 21. Each of the insertion guide grooves 28 is communicated at its innermost portion with a rotation guide groove 29 which is formed in a range of 90 degrees in the circumferential direction. A pair of guide projections 30 which are slidably inserted into the insertion guide grooves 28 and the rotation guide grooves 29 are provided at the outer peripheral surface of the adapter 22 in an opposite relation with an angular interval of 180 degrees therebetween.

The pair of the insertion guide grooves 28 of the insertion hole 23 are formed concentrically with the power source side contact points 24*b* which are disposed at the inner peripheral wall 23*b* in an opposite relation with an angular interval of 180 degrees therebetween. On the other hand, each of the pair of the guide projections 30 of the adapter 22 is deviated by 90 degrees in the circumferential direction with respect to the corresponding one of the load side contact points 25*b* which are provided at the portions of the outer peripheral surface 22*b* in an opposite relation with an angular interval of 180 degrees therebetween. That is, the power source side contact point 24*b* of the cigar lighter socket main body 21 and the load side contact point 25*b* of the adapter 22 are disposed so that they are not contact with each other when the adapter 22 is inserted into the insertion hole 23 along the insertion guide grooves 28.

As explained in detail in FIG. 4, an auxiliary contact points 31 formed by low electric conductivity member are respectively provided in close contact to the power source side contact points 24*b* on the inner peripheral wall 23*b* of the cigar lighter socket main body 21. Therefore, each of the auxiliary contact points 31 is electrically connected to the corresponding power source side contact point 24*b*. Each of the auxiliary contact points 31 is disposed on the upstream side with respect to the power source side contact point 24*b* in a rotation direction for attaching the adapter 22 with the cigar lighter socket main body 21, that is, on such a side that the auxiliary contact point is contacted with the load side contact point prior to the power source side contact point 24*b* when the inserted adapter 22 is rotated to attach with the cigar lighter socket main body 21. The auxiliary contact point 31 is comprised of conductive rubber or conductive resin, for example.

Next, the explanation will be made as to an operation of attaching the adapter 22 with the cigar lighter socket main body 21.

Figure 3A:
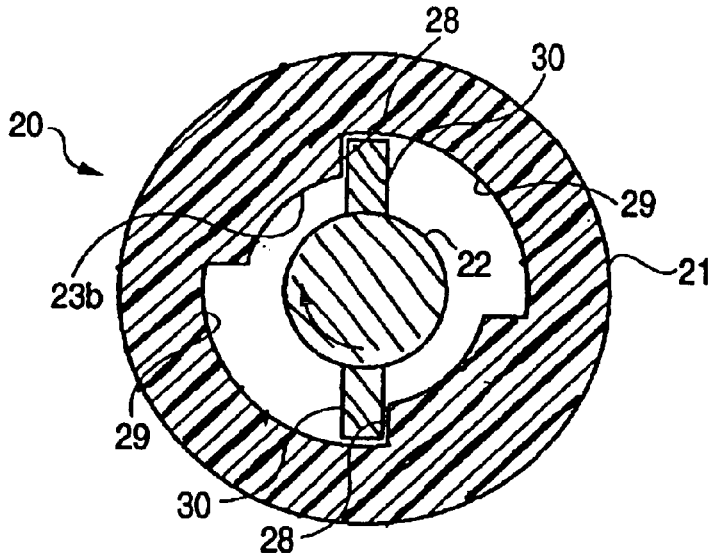
Figure 4A:
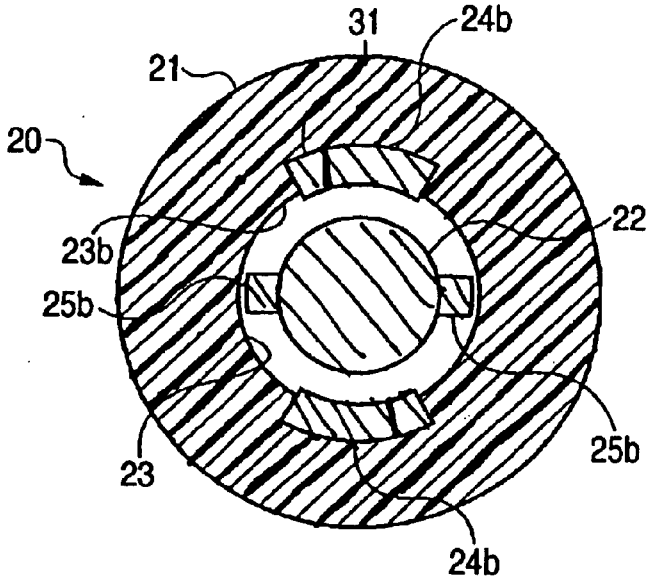

As shown in FIG. 3A, the pair of the guide projections 30 of the adapter 22 are respectively positioned or aligned with the pair of the insertion guide grooves 28 of the cigar lighter socket main body 21. Then the adapter 22 is inserted into the insertion hole 23. In a state where the adapter 22 is inserted, the power source side contact point 24*a* provided at the bottom wall 23*a* of the insertion hole 23 is contacted with the load side contact point 25*a* provided at the tip end surface 22*a* of the adapter 22. However, as shown in FIG. 4A, since the power source side contact point 24*b* provided on the inner peripheral wall 23*b* of the insertion hole 23 is separated from the load side contact point 25*b* provided on the outer peripheral surface 22*b* of the adapter 22, so that the power source line for supplying the vehicle power source to the adapter 22 is placed in an off state.

Figure 3B:
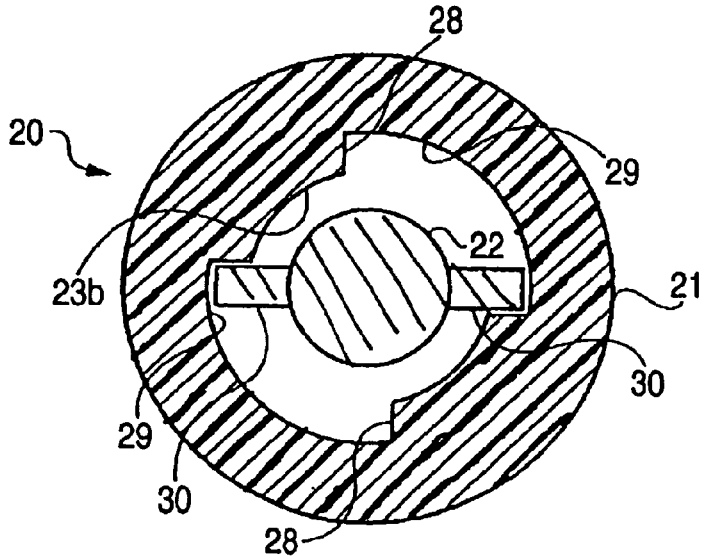
Figure 4B:
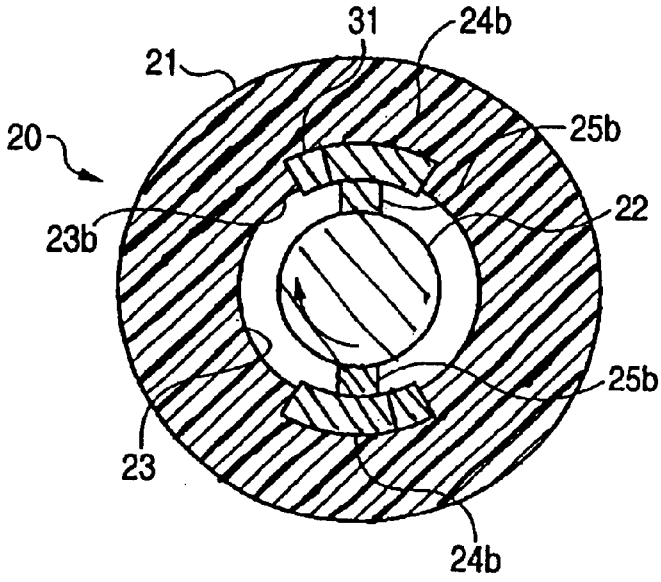

In this state, as shown in FIG. 3B, the adapter 22 is rotated by 90 degrees in a manner that the pair of the guide projections 30 of the adapter 22 are moved along the pair of the rotation guide grooves 29 of the cigar lighter socket main body 21. Then, the adapter 22 is positioned or aligned and fixed at the cigar lighter socket main body 21. Further, as shown in FIG. 4B, the power source side contact points 24*a* provided on the inner peripheral wall 23*b* of the insertion hole 23 are contacted with the load side contact points 25*b* provided on the outer peripheral surface 22*b* of the adapter 22, whereby the power source line for supplying the vehicle power source to the adapter 22 becomes an on state.

In this respect, according to the rotation of the adapter 22, each of the load side contact points 25*b* provided at the outer peripheral surface 22*b* of the adapter 22 is contacted with the corresponding power source side contact point 24*b* of the inner peripheral wall 23*b* of the cigar lighter socket main body 21 after the corresponding auxiliary contact point 31 is contacted with the corresponding power source side contact point 24*b*. In a state where the load side contact point 25*b* is electrically connected with the corresponding power source side contact point 24*b* through the corresponding auxiliary contact point 31, a low current flows therebetween. A high current flows for the first time when the load side contact point 25*b* is directly contacted with the corresponding power source side contact point 24*b*. Thus, in a high-voltage vehicle with an output power of 42 volts on which a motor generator is mounted, it is possible to prevent occurrence of the arc discharge at the time of inserting and drawing the adapter 22 thereby to improve safety and prevention of disaster property for a user and also can prevent the damage of the respective contact points 24*a*, 24*b*, 25*a*, 25*b*.

Figure 5A:
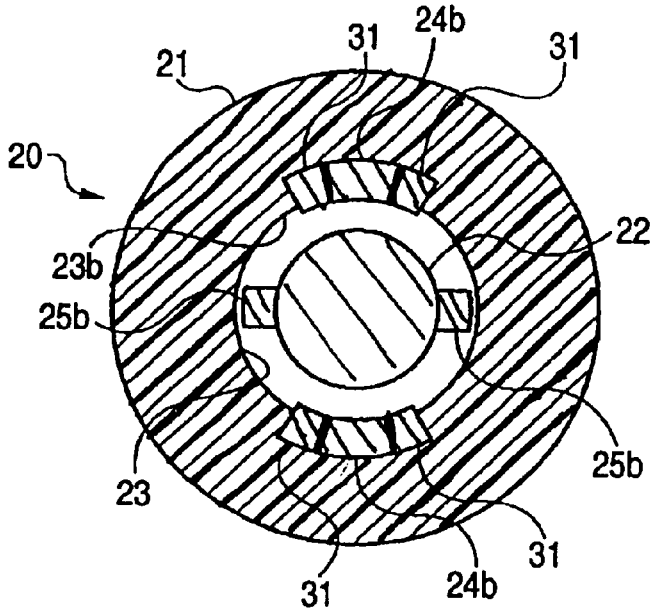
Figure 5B:
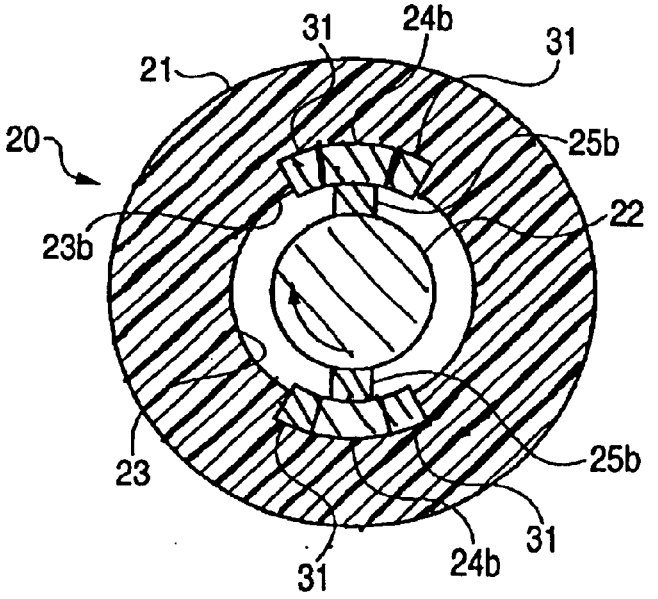
Figure 6:
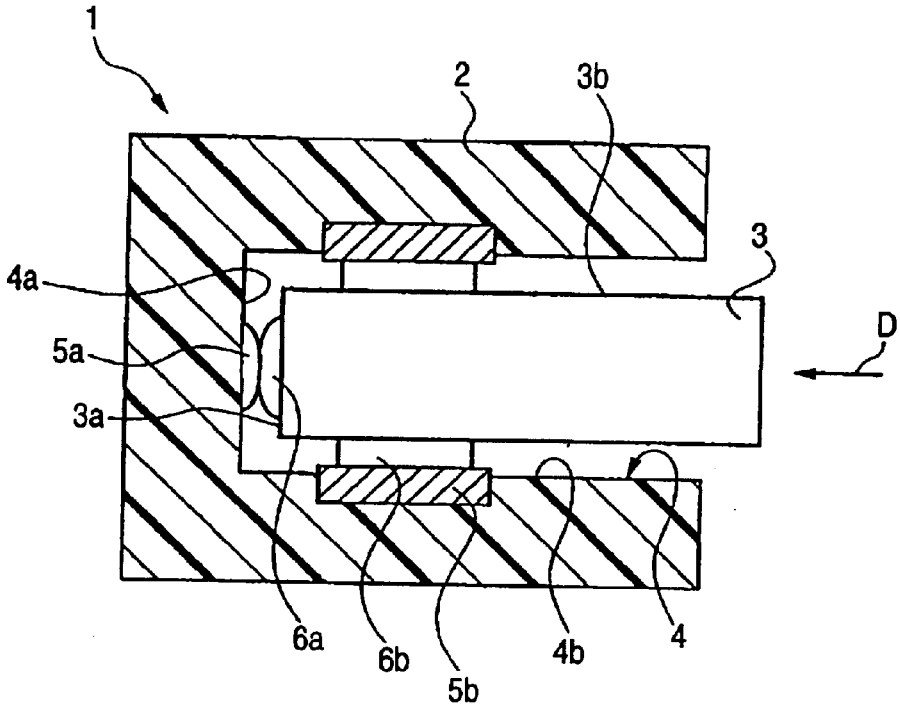
FIG. 6 PRIOR ART
FIG. 6 is a sectional diagram showing a related example and showing a state where an adapter is attached to a socket main body for a cigar lighter.
Figure 7:
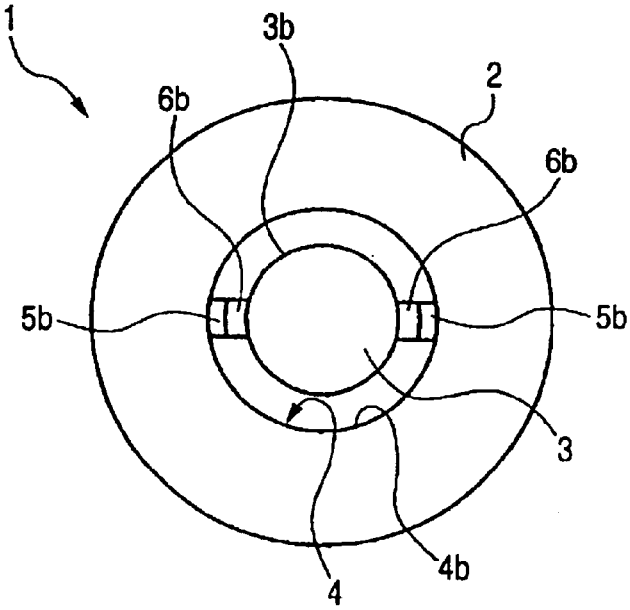
FIG. 7 PRIOR ART
FIG. 7 is a sectional diagram showing a related example and seen from a direction shown by an arrow D in FIG. 6.

Next, a second embodiment of the present invention will be explained based on FIGS. 5A and 5B. FIG. 5A is a sectional diagram showing a state where the adapter 22 is inserted and both the contact points are placed in a non-conductive state therebetween, and FIG. 5B is a sectional diagram showing a state where the inserted adapter 22 is rotated and both the contact points are placed in a conductive state therebetween.

According to the embodiment, the auxiliary contact points 31 each formed by low electric conductivity member are provided at the left and right sides of each of the power source side contact points 24*b* provided on the inner peripheral wall 23*b* of the cigar lighter socket main body 21, respectively. In this embodiment, portions with the same configurations as those of the first embodiment are referred to by the common symbols, with explanation thereof being omitted.

That is, like the first embodiment, in the case where the adapter 22 inserted into the insertion hole 23 is arranged to be able to rotate only in one direction, each of the auxiliary contact points 31 may be disposed on the upstream side with respect to the power source side contact point 24*b* in the rotation direction for attaching the adapter 22 with the cigar lighter socket main body 21, that is, on such a side that the auxiliary contact point is contacted with the load side contact point prior to the power source side contact point 24*b* when the inserted adapter 22 is rotated. Such an arrangement can not apply the case where the adapter 22 inserted into the insertion hole 23 is rotatable in both the left and right directions. However, if the power source socket apparatus is configured like the second embodiment, the apparatus can apply the case where the adapter 22 inserted into the insertion hole 23 is rotatable selectively in the left and right directions.

Figure 8A:
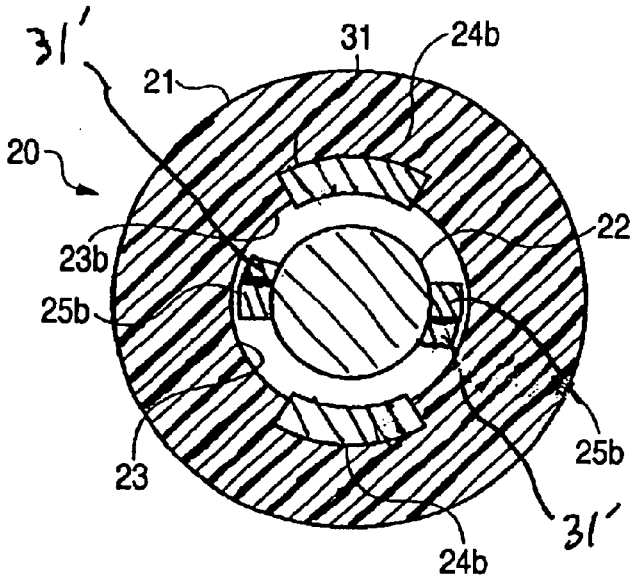
Figure 8B:
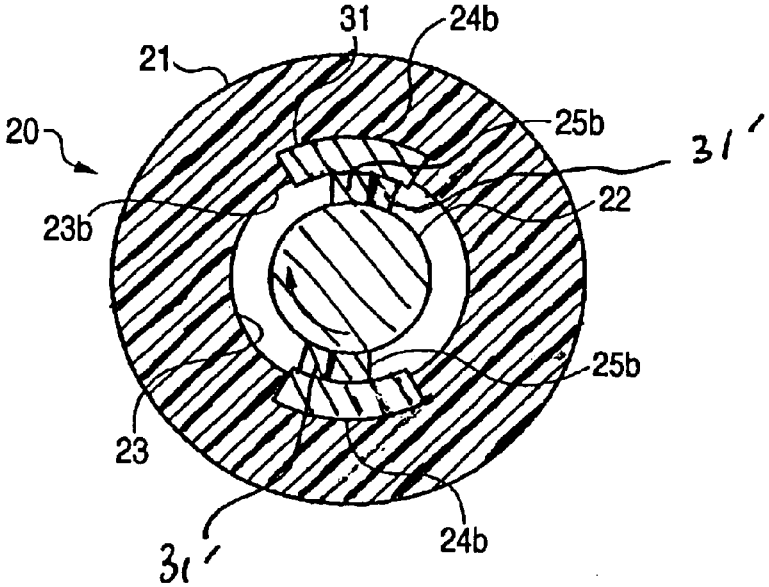

Although, according to the first embodiment, the auxiliary contact point 31 is provided on adjacent to the power source side contact point 24*b* of the cigar lighter socket main body 21, the auxiliary contact point 31' may be provided on adjacent to the load side contact point 25*b* of the adapter 22, as shown in FIGS. 8A and 8B, or may be provided on adjacent to both the power source side contact point 24*b* of the cigar lighter socket main body 21 and the load side contact point 25*b* of the adapter 22 respectively.

Although the invention is applied to the socket main body of a cigar lighter in the first and second embodiments, of course, the invention may also be applied to the socket main body other than a cigar lighter.

What is claimed is:

1. A socket apparatus for supplying a power source, comprising:

a cylindrical adapter having a front face and an outer peripheral face, including;

a guide portion, provided on the outer peripheral face;

a first contact portion, provided on the front face; and a second contact portion, provided on the outer peripheral face, and socket body having a cylindrical insertion hole into which the adapter is inserted, including;

a first guide groove for guiding the guide portion, provided on an inner peripheral face of the insertion hole;

a third contact portion, provided on a bottom face of the insertion hole, and electrically connected to the first contact portion when the adapter is inserted into the insertion hole;

a fourth contact portion, provided on the inner peripheral face, and capable of being electrically connected to the second contact portion; and a second guide groove, provided on the inner peripheral face so that the adapter pivots while the guide portion engages the second guide groove;

a fifth contact portion, provided on at least one of the inner peripheral face of the insertion hole and the outer peripheral face of the cylindrical adapter so as to contact at least one of the second contact portion and the fourth contact portion, and the electrical conductivity of the fifth contact portion is lower than that of the contacted at least one of the second contact portion and the fourth contact portion, and wherein the fifth contact portion is disposed on an upstream side with respect to a rotation path of the second contact portion of the adapter.

2. The socket apparatus as set forth in claim 1, wherein the fifth contact portion is provided on the inner peripheral face of the insertion hole so as to be continuously connected to the fourth contact portion.

3. The socket apparatus as set forth in claim 1, wherein the second contact portion is separated from the fourth contact portion in a state that the adapter is inserted into the insertion hole along the first guide groove.

4. The socket apparatus as set forth in claim 1, wherein the second guide groove communicates with the first guide groove at a lower portion of the first guide groove; and wherein the second guide groove is extending in a circumferential direction of the insertion hole.

* * * * *